US005109561A

United States Patent [19]

Schild

[11] Patent Number: 5,109,561

[45] Date of Patent: May 5, 1992

[54] ALTERNATING PRESSURE PAD

[75] Inventor: Rolf Schild, London, England

[73] Assignee: Huntleigh Technology, Plc, United Kingdom

[21] Appl. No.: 543,752

[22] PCT Filed: Mar. 8, 1989

[86] PCT No.: PCT/GB89/00233

§ 371 Date: Aug. 23, 1990

§ 102(e) Date: Aug. 23, 1990

[87] PCT Pub. No.: WO89/08439

PCT Pub. Date: Sep. 21, 1989

[51] Int. Cl.[5] ..... A47C 27/08

[52] U.S. Cl. ..... 5/453; 5/455

[58] Field of Search ..... 5/453, 455, 456, 457, 5/441, 458

[56] References Cited

U.S. PATENT DOCUMENTS 3,605,145 9/1971 Graebe ..... 5/456
3,909,858 10/1975 Ducker ..... 5/456 X
4,120,061 10/1978 Clark ..... 5/456
4,134,166 1/1979 Schuder ..... 5/456
4,694,521 9/1987 Tominaga ..... 5/453
4,944,060 7/1990 Peery et al. ..... 5/453
4,962,552 10/1990 Hasty ..... 5/453
4,979,375 12/1990 Nathans et al. ..... 5/453 X

FOREIGN PATENT DOCUMENTS 02244 4/1986 World Int. Prop. O. ..... 5/453

*Primary Examiner*—Renee S. Luebke
*Assistant Examiner*—Michael Milano
*Attorney, Agent, or Firm*—Fitzpatrick, Cella, Harper & Scinto

[57] ABSTRACT

An alternating pressure pad having at least two sets of alternately inflatable cells, with each cell having a height greater than its width. Each cell having at least one internal membrane arranged to restrict the shape of the cell and divide the cell into two communicating regions wherein the width of the lower of the two regions is greater than the width of the upper of the two regions.

14 Claims, 2 Drawing Sheets

ALTERNATING PRESSURE PAD

This invention relates to alternating pressure pads, and in particular to alternating pressure pads of the kind used in the prevention and management of decubitus ulcers in bedridden patients.

The formation of decubitus ulcers, commonly known as bedsores, results from, amongst other things, the pressure applied to certain portions of the skin of a bedridden patient. In addition, it is well known that should the lower reflex arc be broken by, for instance, lesion of the spinal cord or of nerve roots then decubitus ulcers of unusual severity and rapidity of onset are likely to develop. It is known to meet the requirement for the prevention and management of decubitus ulcers with an alternating pressure pad comprising two sets of alternatively inflatable cells: the duration of the inflation and deflation cycles may last from under two minutes for a gentle massaging effect to over twenty minutes. Huntleigh Technology plc manufacture and supply such an alternating pressure pad system.

The comparative advantages of different sizes and shapes of inflatable cells are well known. Ideally, support provided by a given region of a pad should not be effected by the pressure applied by a patient to adjacent regions. Comfort therefore dictates a cell of small width. A small width cell is generally made as a cell which is small in both height as well as width. Such a cell, however, may not provide sufficient support for heavy patients or the larger bony protuberances of even relatively light patients unless pressurised to an uncomfortably high support pressure.

Consequently, in order to provide sufficient support it has been found necessary to use units which inflate to provide a pad of substantial thickness. Hitherto, this has been achieved by the use of large diameter units since, clearly, large diameter units inflate to a greater thickness than smaller diameter units. Patient comfort has, however, suffered.

Reconciling the advantages of small cells to large cells has hitherto been accomplished by providing a double layer pad, being essentially two alternating pressure pads laid one on top of the other to provide a maximum inflation height twice that of a single layer pad. This is particularly advantageous where there is a need for the lowest possible support pressure and greatest patient comfort, for instance with intensive care patients. There are, however, significant disadvantages in such known arrangements. For instance, it may be difficult to keep cells on top of one another properly aligned, there being a tendency for an inflated tube in the upper layer to slide into the void left by the adjacent deflated tube.

In accordance with the present invention, an alternating pressure pad comprises at least two sets of alternately inflatable cells, each cell of height greater than width and comprising at least one internal membrane arranged to restrict the shape of said cell and divide the cell into two communicating regions characterised in that the width of the lower of the two regions is greater than the width of the upper of the two regions.

By providing an internal membrane in the cell which restricts the shape of the cell, the advantages hitherto associated with small cells as well as those associated with large cells are obtained. Further, the air supply system for inflating such a pad is considerably simpler than that of a double layer pad.

Preferably, the internal membrane is substantially parallel to the plane of the pad.

Such a cell structure has significant advantages since it provides improved stability of the upper region and ensures that the area of the patient's skin enjoying pressure relief is always greater than the supported area.

Preferably, the fluid for inflating each cell is supplied at one end of each cell and there is a gap in the membrane at each end to allow fluid to pass freely between the two regions.

Preferably, the membrane extends from the gaps over substantially the whole length of said cell.

Preferably, the alternating pressure pad further comprises a base sheet, at least one strap restraining each cell, the strap being attached to the base sheet, and the centres of adjacent cells being separated by a distance equal to the maximum width of each cell.

Preferably, the membrane divides the cell into two regions of quasi-rectangular cross-section.

Preferably, each set of cells has a manifold comprising a tube of flexible impervious material extending transversely of the cells and connected to feed fluid to the cells of the set, and an incollapsible structure located in the tube to ensure that, in use, the manifold is not compressed.

Preferably, the incollapsible structure is a piece of corrugated plastic tubing.

A preferred embodiment of the present invention will now be described in detail by way of example only, with reference to the accompanying drawings of which:

Figure 1:
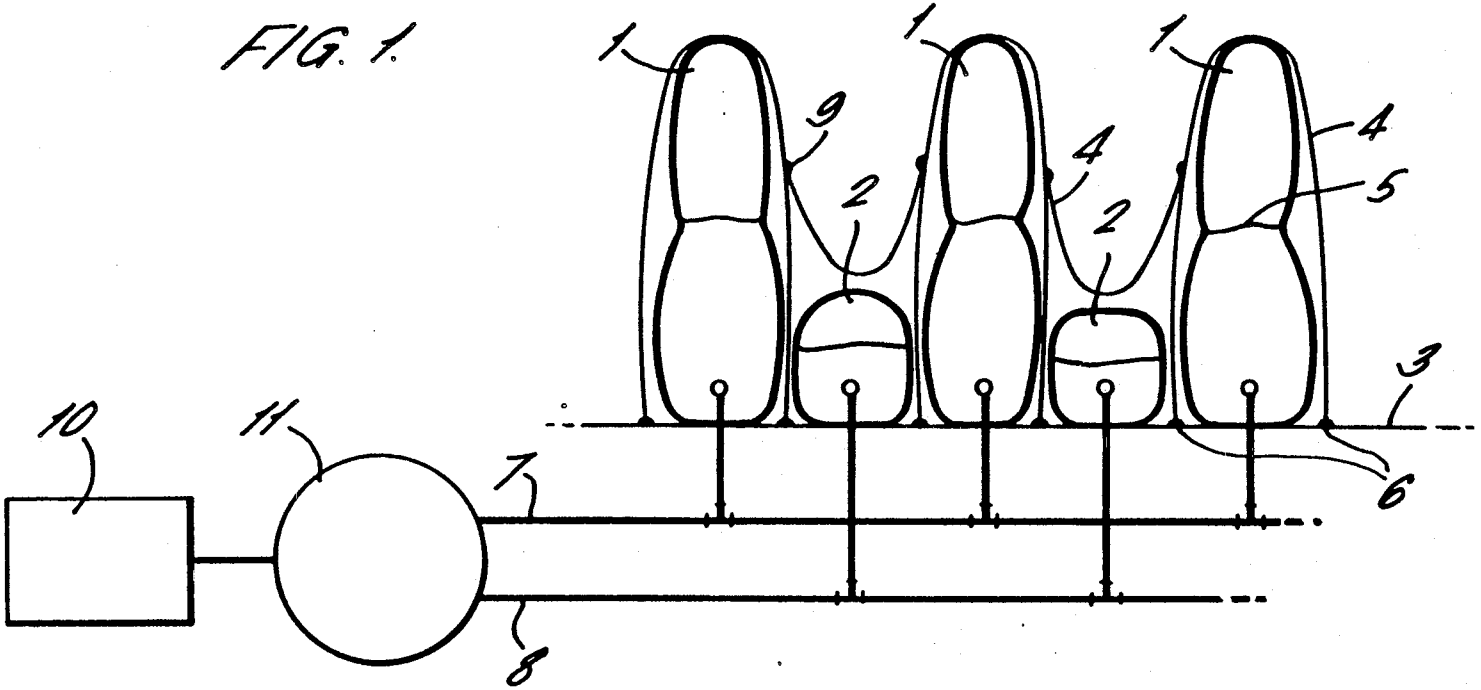
FIG. 1 is a schematic cross-sectional representation of an alternating pressure pad according to the present invention.

Referring to FIG. 1, a first set of inflatable cells 1 and a second set of inflatable cells 2 are shown, the first set being fully inflated and the second set fully deflated. The two sets are alternately inflatable and are supplied with air from a compressor 10 feeding a rotary valve 11. The first and second sets are supplied air from respective feed lines 7 and 8.

There is provided a base sheet 3 of plastics material to which may be attached restraining straps 4 of plastics material, each cell being retained in position by at least one such strap 4. Adjacent straps are attached to one another by welds 9. An internal membrane 5 is attached between the sides of each cell and restricts the shape of the cell so that, on inflation of a given cell, the cell is internally divided into 2 communicating regions. Preferably, the membrane will be substantially parallel to the plane of the pad and the 2 regions will be of unequal size, the lower of the two regions being wider than the upper of the two regions. Air feed lines 7 and 8 supply air to each cell through an aperture in one end of each cell. There is provided a gap in the membrane at each end to allow air to pass freely between the two regions. The membrane extends from the gaps over substantially the whole length of said cell.

The cells are generally tubular and of approximately constant cross-section, with height greater than width on full inflation. It is preferable for the internal membrane to be positioned at about 55% of the height of the inflated cell so that the lower region is wider than the upper region when inflated. The cross-sectional shape of each inflated cell is preferably two quasi rectangular regions with curved sides. By arranging for the width of the upper region to be smaller than the lower region, improved stability of the upper region is provided for. In addition, it ensures that the unsupported area enjoying pressure relief is always larger than the supported area. The quasi-rectangular shape of each inflated region is also very much more rigid than conventional circular or elliptical cells allowing the required vertical alignment to be more easily maintained.

Each cell may be made from a rectangular sheet approximately 51 cm×89 cm. A rectangular membrane measuring approximately 3.1 cm to 5 cm×86 cm may be radio frequency welded to one side of the sheet so that when the sheet is folded in half along the shorter side, and welded together along the three pairs of edges, a single cell is formed having an internal membrane at about 55% of the height of the cell. An aperture for the passage of air from the respective feed line is formed in each end, and the membrane is preferably positioned so that there is a 3 cm gap between each end and the membrane to allow air to pass freely between the two regions.

Figure 2:
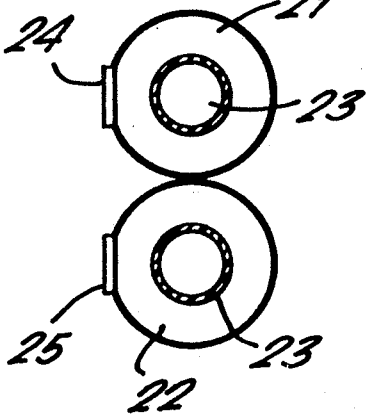
FIG. 2 is a cross-sectional view of manifolds suitable for feeding fluid to the sets of cells in FIG. 1.

The sets of cells are supplied with fluid by manifolds which run along the side of the cells. Two such manifolds are shown in FIG. 2, one manifold feeding each set of cells. An incollapsible tube 23 is located in each of the manifolds 21 and 22 and serves to ensure that if a manifold is resting against a surface e.g., the sides of a bed, the fluid supply to the sets of cells will not be blocked as a result of compression of the manifold. The manifolds are connected to the sets of cells by connectors 24 and 25. Connectors 24 are located at positions along the manifold 21 to feed fluid to one set of cells and connectors 25 are located at positions along manifold 22 to feed fluid to the other set of cells.

Figure 3:
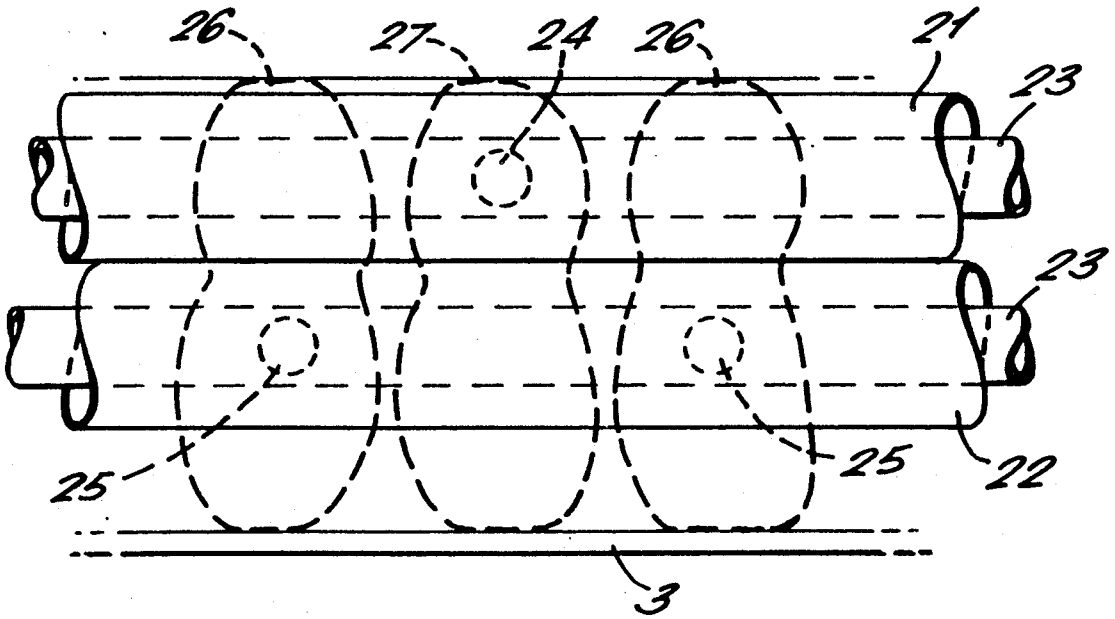
FIG. 3 shows how the manifolds in FIG. 2 are arranged with respect to the sets of cells in FIG. 1.

FIG. 3 shows the manifolds 21 and 22 running along the side of the sets of cells 26 and 27. Connectors 24 can be seen to connect cells 27 to the fluid supply and connectors 25 can be seen to connect cells 26 to the fluid supply.

I claim:

1. Alternating pressure pad comprising at least two sets of alternately inflatable cells, each cell of height greater than width and comprising at least one internal membrane arranged to restrict the shape of said cell and divide the cell into two communicating regions, wherein the maximum width of the lower of the two regions is greater than the maximum width of the upper of the two regions when fully inflated.

2. Alternating pressure pad as claimed in claim 1, wherein the internal membrane is arranged to be substantially parallel to the plane of the pad.

3. Alternating pressure pad as claimed in claim 1, wherein the fluid for inflating each cell is supplied at one end of each cell and there is a gap in the membrane at each end to allow fluid to pass freely between the two regions.

4. Alternating pressure pad as claimed in claim 3, wherein the membrane extends from the gaps over substantially the whole length of said cell.

5. Alternating pressure pad as claimed in claim 2, wherein the fluid for inflating each cell is supplied at one end of each cell and there is a gap in the membrane at each end to allow fluid to pass freely between the two regions.

6. Alternating pressure pad as claimed in claim 1, 2, 3, 4 or 5 further comprising a base sheet, at least one strap restraining each cell, the strap being attached to the base sheet, and the centers of adjacent cells being separated by a distance equal to the maximum width of each cell.

7. Alternating pressure pad as claimed in claim 1, 2, 3, 4 or 5, wherein the membrane divides the cell into two regions of quasi-rectangular cross-sections.

8. An alternating pressure pad as claimed in claim 1, 2, 3, 4 or 5, wherein each set of cells has a manifold comprising a tube of flexible impervious material extending transversely of the cells and connected to feed fluid to the cells of the set, and an incollapsible structure located in the tube to ensure that, in use, the manifold is not compressed.

9. An alternating pressure pad as claimed in claim 8, wherein the incollapsible structure is a piece of corrugated plastic tubing.

10. Alternating pressure pad as claimed in claim 6, wherein the membrane divides the cell into two regions of quasi-rectangular cross-sections.

11. An alternating pressure pad as claimed in claim 6, wherein each set of cells has a manifold comprising a tube of flexible impervious material extending transversely of the cells and connected to feed fluid to the cells of the set, and an incollapsible structure located in the tube to ensure that, in use, the manifold is not compressed.

12. An alternating pressure pad as claimed in claim 7, wherein each set of cells has a manifold comprising a tube of flexible impervious material extending transversely of the cells and connected to feed fluid to the cells of the set, and an incollapsible structure located in the tube to ensure that, in use, the manifold is not compressed.

13. An alternating pressure pad as claimed in claim 11, wherein the incollapsible structure is a piece of corrugated plastic tubing.

14. An alternating pressure pad as claimed in claim 12, wherein the incollapsible structure is a piece of corrugated plastic tubing.

* * * * *